US006788793B2

(12) United States Patent
Tanemura et al.

(10) Patent No.: US 6,788,793 B2
(45) Date of Patent: Sep. 7, 2004

(54) SPEAKER SYSTEM FOR AN ELECTRONIC DEVICE

(75) Inventors: Tetsuo Tanemura, Yokohama (JP); Tatsuya Yoshino, Yokosuka (JP)

(73) Assignee: Motorola, Inc., Schaumburg, IL (US)

( * ) Notice: Subject to any disclaimer, the term of this patent is extended or adjusted under 35 U.S.C. 154(b) by 80 days.

(21) Appl. No.: 10/161,836

(22) Filed: Jun. 4, 2002

(65) Prior Publication Data

US 2003/0223610 A1 Dec. 4, 2003

(51) Int. Cl.[7] ..... H04R 25/00

(52) U.S. Cl. ..... 381/152; 381/333; 381/190; 381/388; 345/168; 361/680

(58) Field of Search ..... 381/87, 89, 306, 381/333, 332, 335, 388, 334; 361/680, 681, 682, 683; 345/168, 169, 156

(56) References Cited

U.S. PATENT DOCUMENTS

| | | | | | |
|---|---|---|---|---|---|
| 5,283,836 | A | | 2/1994 | Trufitt | |
| 5,721,787 | A | | 2/1998 | Neibaur et al. | |
| 5,729,604 | A | | 3/1998 | Van Schyndel | |
| 5,940,015 | A | | 8/1999 | Thornton et al. | |
| 6,008,714 | A | * | 12/1999 | Okuda et al. | 336/200 |
| 6,011,470 | A | * | 1/2000 | Schulte et al. | 340/552 |
| 6,052,464 | A | | 4/2000 | Harris et al. | |
| 6,121,958 | A | * | 9/2000 | Clark et al. | 361/683 |
| 6,137,883 | A | | 10/2000 | Kaschke et al. | |
| 6,304,434 | B1 | | 10/2001 | Markow | |
| 6,331,850 | B1 | | 12/2001 | Olodort et al. | |
| 6,332,029 | B1 | * | 12/2001 | Azima et al. | 381/152 |
| 6,580,799 | B1 | * | 6/2003 | Azima et al. | 381/333 |
| 2002/0003450 | A1 | | 1/2002 | Pearson, Jr. et al. | |
| 2002/0018683 | A1 | | 2/2002 | Roysden, Jr. | |
| 2002/0025837 | A1 | | 2/2002 | Levy | |
| 2002/0027999 | A1 | | 3/2002 | Azima et al. | |
| 2002/0048589 | A1 | | 4/2002 | Heerklotz et al. | |

FOREIGN PATENT DOCUMENTS

| | | | | |
|---|---|---|---|---|
| JP | 11-143579 | * | 5/1999 | G06F/1/16 |

OTHER PUBLICATIONS

Motorola brochure for Trade Booth #5139, "Experience the Future . . . IDEN@CTIA'98," Mar. 19, 1998, 2 pages.

* cited by examiner

*Primary Examiner*—Curtis Kuntz
*Assistant Examiner*—Brian Ensey
(74) *Attorney, Agent, or Firm*—Randall S. Vaas

(57) ABSTRACT

A speaker system for an electronic device includes a keypad with keys, a housing with first spaces for receiving respective ones of the keys, and a flat speaker located under the keypad. The keys and the first spaces are sized such that there are gaps between the keys and the housing when the keys are received within the first spaces. The speaker is co-planar with the keypad and when sound is projected from the speaker, it is emitted through the gaps between the keys and the housing.

15 Claims, 2 Drawing Sheets

-PRIOR ART-

SPEAKER SYSTEM FOR AN ELECTRONIC DEVICE

BACKGROUND OF THE INVENTION

The present invention relates to an electronic device with a keypad and an audio speaker, and more particularly, to an electronic device with a keypad and a planar electromagnetic transducer that is co-planar to the keypad.

FIG. 1 is a cross-sectional view of a cone-type speaker 10. The cone-type speaker 10 moves a cone 12 in response to an amplified, electrical audio signal to produce a sound wave. The cone 12 is attached at one end to a coil 14 and at an opposing end to a to an outer ring of a speaker support 16 with a flexible mounting 18. The coil 14 is mounted so that it can move freely inside of a magnetic field of a permanent magnet 20. An enclosure 22 is provided to minimize the impact of the mechanical frequency of vibration of the cone. Such cone-type speakers require a relatively large amount of space and, unless quite expensive, have a limited dynamic range.

An alternative to the dynamic speaker is the electrostatic loudspeaker. The electrostatic principle provides a more faithful rendition of sound due to the superior speed and control of its diaphragm. Instead of a cone and its many associated parts, the electrostatic speaker uses a thin sheet of polyester or plastic material stretched taught on a frame and spaced between two stator plates. The diaphragm is charged with a high static voltage and a signal from the amplifier is applied to the stator plates through a step-up transformer to raise the signal's voltage. The changing voltage on the stators moves the diaphragm back and forth, which in turn pushes the air around the diaphragm and creates sound. Since the diaphragm is extremely light, it is also extremely fast and thus responds quickly and accurately to audio signals. This gives such flat speakers an extraordinarily "clear" sound.

Another alternative is the planar magnetic speaker, such as disclosed in U.S. Pat. No. 5,283,836 and U.S. Pat. No. 6,008,714. Planar-magnetic speakers use a membrane with a coil etched into it and located between two magnetic panels. They basically work the same way as electrostatic speakers, except that the alternating positive and negative current moves the membrane in a magnetic field rather than an electric field. Like electrostatic speakers, they produce high-frequency sound with extraordinary precision.

Most electronic devices today include a cone-type dynamic loudspeaker. However, as discussed above, such cone-type speakers, unless at the very high end, do not reproduce sound as well as flat panel speakers. Further, the speaker cone requires a relatively large amount of space. Since electronic devices are being used to play audio files, such as music stored in an MP3 file, it would be desirable to provide such electronic devices with a higher fidelity sound system.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments that are presently preferred. It should be understood, however, that the invention is not limited to the precise arrangements and instrumentalities shown. In the drawings.

DETAILED DESCRIPTION OF PREFERRED EMBODIMENTS

Figure 1:
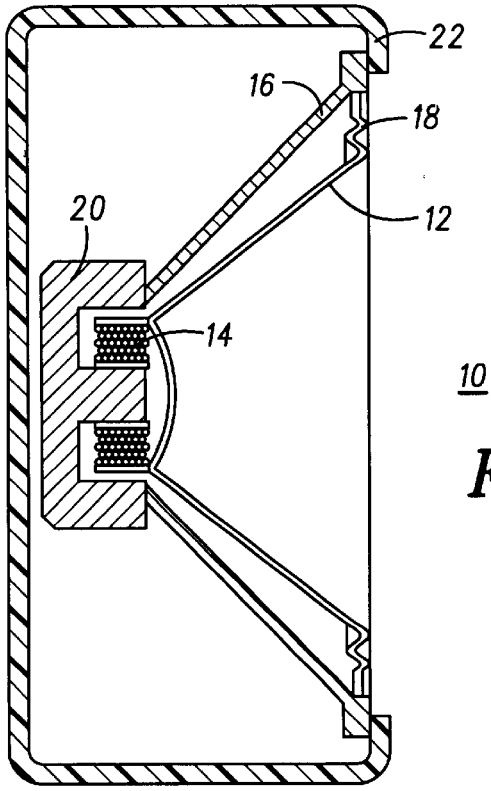
FIG. 1 is an enlarged cross-sectional view of a conventional cone-type speaker.

The detailed description set forth below in connection with the appended drawings is intended as a description of the presently preferred embodiments of the invention, and is not intended to represent the only forms in which the present invention may be practiced. It is to be understood that the same or equivalent functions may be accomplished by different embodiments that are intended to be encompassed within the spirit and scope of the invention.

Certain features in the drawings have been enlarged for ease of illustration and the drawings and the elements thereof are not necessarily in proper proportion. However, those of ordinary skill in the art will readily understand such details. In the drawings, like numerals are used to indicate like elements throughout.

In order to provide an electronic device with improved audio fidelity, the present invention provides a keypad having a plurality of keys, a housing with first spaces for receiving respective ones of the plurality of keys of the keypad, wherein the keys and the first spaces are sized such that there are gaps between the keys and the housing when the keys are received within the first spaces, and a planar audio speaker located under the keypad. The speaker is co-planar with the keypad. Sound projected from the speaker is emitted through the gaps between the keys and the housing.

The present invention also provides a speaker system for an electronic device, where the electronic device includes a keypad having a plurality of keys and a housing with first spaces for receiving respective ones of the plurality of keys of the keypad. The keys and the first spaces are sized such that there are gaps between the keys and the housing when the keys are received within the first spaces. The speaker system comprises a planar audio speaker located under the keypad. The speaker is co-planar with the keypad. Sound projected from the speaker is emitted through the gaps between the keys and the housing.

Figure 2:
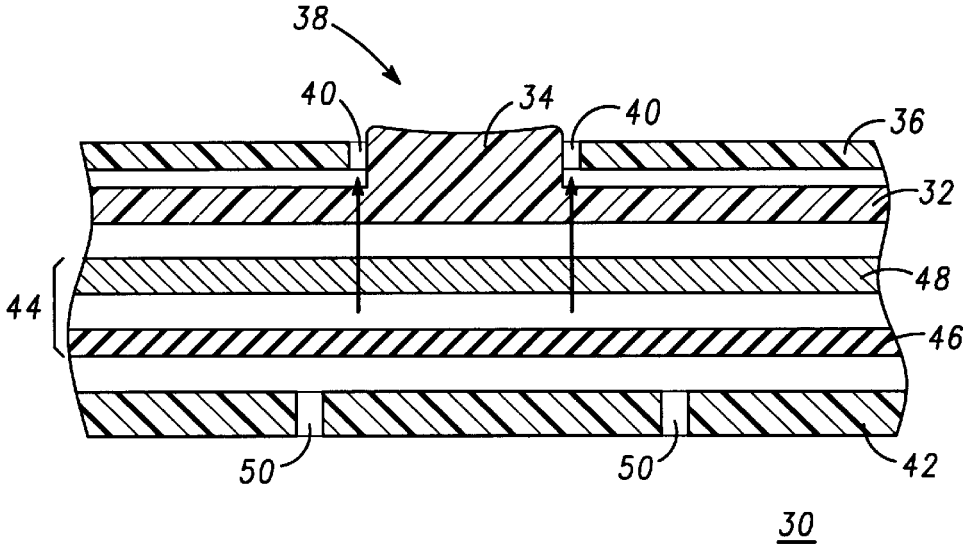
FIG. 2 is an enlarged, partial cross-sectional view of an electronic device in accordance with a first embodiment of the present invention.

Referring now to FIG. 2, an enlarged cross-sectional view of an electronic device 30 in accordance with a first embodiment of the present invention is shown. The electronic device 30 may be any type of electronic device that includes a keypad, such as a personal computer, a cellular telephone, and the like. The electronic device 30 has a keypad 32 having a plurality of keys 34. For ease of illustration, only one of the keys 34 is shown. The keypad 32 may be a full QWERTY type keypad, a numeric keypad, or any other type of keypad used to input information into the device 30. The device 30 also has a housing 36. The housing 36 includes first spaces 38 for receiving respective ones of the plurality of keys 34 of the keypad 32. The keys 34 and the first spaces 38 are sized such that there are gaps 40 between the keys 34 and the housing 36 when the keys 34 are received within the first spaces 38. The gaps 40 should be as large as possible from an acoustic perspective, however, this need must be balanced with other requirements, such as housing rigidity, keeping dust from entering the housing 36, and aesthetics.

The electronic device 30 also has a keypad printed circuit board (PCB) 42. The PCB 42 interacts with the keys 34 in a manner known to those of ordinary skill in the art such that when a key 34 is depressed, a corresponding electrical signal is generated in the keypad PCB 42.

A planar audio speaker 44 is located under the keypad 32 and above the PCB 42 and is co-planar with the keypad 32 and the PCB 42. The speaker 44 is preferably formed from a flexible printed circuit diaphragm 46 and a magnet 48. Planar-type audio speakers are known by those of ordinary skill in the art. The diaphragm 46 is made of a plastic material and has a metal coil embedded therein. The diaphragm 46 is preferably a polyimide flexible printed circuit. However, other materials, such as polyester may also be used. The magnet 48 is preferably a neodymium-iron-boron (NdFeB) bonded magnet, which has excellent magnetic values, strength, corrosion resistance, and temperature stability. Such NdFeB magnets are generally commercially available, such as from Daido Steel Co. of Tokyo, Japan. The speaker 44 and thus the diaphragm 46 and the magnet 48 are flexible such that, as discussed above, when a key 34 is depressed, it is sensed by the keypad PCB 42.

In the presently preferred embodiment, in order to make the speaker 44 as thin as possible, the speaker 44 is made with a one-sheet magnet and the magnet 48 is made very thin. For example, the speaker 44 may be sized to fit within a cellular telephone. In one embodiment, the magnet 48 is on the order of 70 mm×40 mm×0.5 mm. While the presently preferred embodiment uses a one-sheet magnet, two sheet magnets, such as disclosed in the aforementioned U.S. Pat. No. 6,008,714 may also be used. The invention is not to be limited by the particular structure of the magnet, so long as the speaker 44 is thin and co-planar with the keypad 32 and sound projected from the speaker 44 is emitted through the gaps 40 between the keys 34 and the housing 36.

In order to project the sound generated by the speaker 44 through the gaps 40 between the keys 34 and the housing 36, the magnet 48 and the keypad 32 include perforations that allow the generated sound to travel along the paths indicated by the arrows in FIG. 2. The keypad PCB 42 may also include rear volume holes 50. The rear volume holes 50 need not be aligned with the perforations in the keypad 32. The rear volume holes 50 are especially desired if there is no air volume between the PCB 42 and the speaker 44. Accordingly, in order to enhance sound loudness and low audio frequency, the presently preferred embodiment includes the rear volume holes 50.

Figure 3:
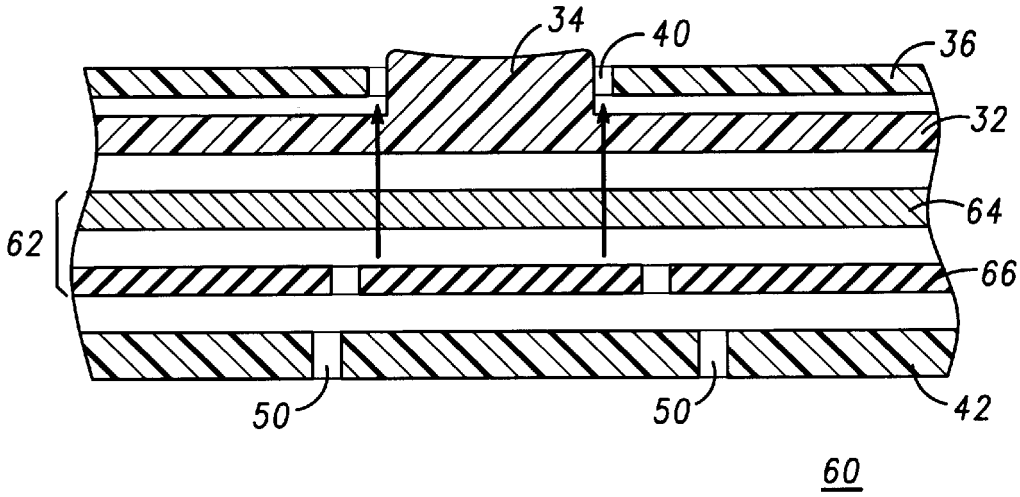
FIG. 3 is an enlarged, partial cross-sectional view of an electronic device in accordance with a second embodiment of the present invention.

Referring now to FIG. 3, an enlarged cross-sectional view of an electronic device 60 in accordance with a second embodiment of the present invention is shown. In the second embodiment, a planar speaker 62 is located between and co-planar to the keypad 32 and the keypad PCB 42. The speaker 62 includes a flexible printed circuit (FPC) 64 and a one-sheet magnet 66. The FPC 64 is located adjacent to the keypad 32 and the magnet 66 is adjacent to the PCB 42. Sound is directed from the FPC 64 in the direction of the arrows, through perforations in the keypad 32 and the gaps between the keys 34 and the housing 36. As with the first embodiment, the keypad PCB 42 is operatively coupled with the keypad 32 even though the speaker 62 is located between the keypad 32 and the keypad PCB 42.

Figure 4:
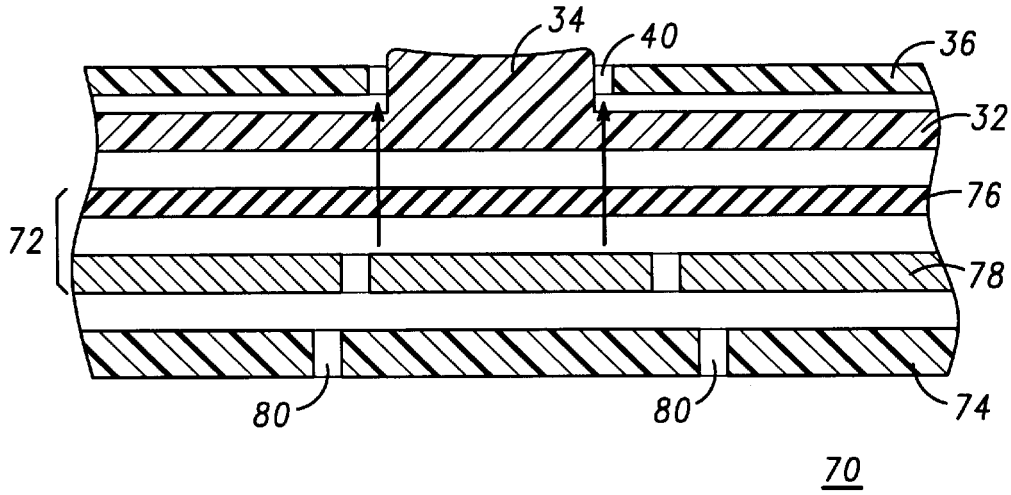
FIG. 4 is an enlarged, partial cross-sectional view of an electronic device in accordance with another embodiment of the present invention.

Referring now to FIG. 4, an enlarged cross-sectional view of an electronic device 70 in accordance with another embodiment of the present invention is shown. In this embodiment, a planar speaker 72 is located between and co-planar to the keypad 32 and a bottom or back side 74 of the chassis 36. The speaker 72 includes a flexible printed circuit (FPC) 76 and a one-sheet magnet 78. The FPC 76 is located adjacent to the keypad 32 and the magnet 78 is adjacent to the chassis back side 74. Sound is directed from the FPC 76 in the direction of the arrows, through perforations in the keypad 32 and the gaps 40 between the keys 34 and the chassis or housing 36. Sound may also be directed in the opposite direction and emitted through holes 80 in the chassis back side 74. In this embodiment, the keypad PCB is integrated with the FPC 76. That is, the keypad PCB circuit pattern is printed onto one side, preferably the top, of the FPC 76 and the speaker pattern is printed onto the other side, i.e., preferably the bottom side, of the FPC 76. Thus, the FPC 76 is operatively coupled with the keypad 32 and performs the dual functions of keypad FPC and speaker diaphragm.

The description of the preferred embodiments of the present invention have been presented for purposes of illustration and description, but are not intended to be exhaustive or to limit the invention to the forms disclosed. It will be appreciated by those skilled in the art that changes could be made to the embodiments described above without departing from the broad inventive concept thereof. For example, the present invention is not limited to the planar speaker disclosed, as other types of planar speakers will perform the same function. Also, the speaker could be located below the keypad PCB, instead of between the keypad and the keypad PBC. Further, the present invention is not limited to any particular electronic device or device package. That is, the invention is applicable to any type of device that has a keypad and an audio output. Further, the FPC 76 and the magnet 78 positions in FIG. 4 could be exchanged. It is understood, therefore, that this invention is not limited to the particular embodiments disclosed, but covers modifications within the spirit and scope of the present invention as defined by the appended claims.

What is claimed is:

1. An electronic device, comprising:

a keypad having a plurality of keys;

a housing with first spaces for receiving respective ones of the plurality of keys of the keypad, wherein the keys and the first spaces are sized such that there are gaps between the keys and the housing when the keys are received within the first spaces;

a planar audio speaker located under the keypad, the speaker being co-planar with the keypad, wherein sound projected from the speaker is emitted through the gaps between the keys and the housing; and a keypad printed circuit board (PCB) operatively coupled with the keypad, wherein the keypad PCB is co-planar with the keypad and the speaker, the speaker is located between the keypad and the keypad PCB, and the keypad has a plurality of holes generally aligned with the gaps.

2. The electronic device of claim 1, wherein the keypad PCB has a plurality of holes therein.

3. The electronic device of claim 1, wherein the planar speaker includes a flexible printed circuit (FPC) diaphragm.

4. The electronic device of claim 3, wherein the FPC diaphragm is made of polyimide.

5. The electronic device of claim 3, wherein the planar speaker further comprises a magnet.

6. The electronic device of claim 5, wherein the magnet comprises a one-sheet magnet.

7. The electronic device of claim 5, wherein the magnet is an NdFeB bonded magnet.

8. The electronic device of claim 5, wherein the magnet has a thickness of about 0.5 mm.

9. The electronic device of claim 5, wherein the magnet includes a plurality of perforations.

10. A speaker system for an electronic device, wherein the electronic device includes a keypad having a plurality of keys and a housing with first spaces for receiving respective ones of the plurality of keys of the keypad, wherein the keys and the first spaces are sized such that there are gaps between the keys and the housing when the keys are received within the first spaces, wherein the keypad has a plurality of holes generally aligned with the gaps between the keys and the housing, the speaker system comprising:

a planar audio speaker located under the keypad, the speaker being co-planar with the keypad, wherein sound projected from the speaker is emitted through the gaps between the keys and the housing; and wherein the speaker includes a flexible printed circuit (FPC) diaphragm and a magnet, and wherein the FPC has a keypad wiring pattern printed on one side thereof that is operatively coupled with the keypad such that the speaker and the keypad are integrated.

11. The speaker system of claim 10, wherein the planar speaker further comprises a one-sheet magnet.

12. The speaker system of claim 10, wherein the magnet is an NdFeB bonded magnet.

13. The speaker system of claim 10, wherein the magnet has a thickness of about 0.5 mm.

14. An electronic device, comprising:

a keypad having a plurality of keys;

a housing with first spaces for receiving respective ones of the plurality of keys of the keypad;

a keypad printed circuit board (PCB) co-planar to and operatively coupled with the keypad; and a planar magnet located below the keypad PCB and co-planar to the keypad and the keypad PCB, wherein the keypad PCB includes a speaker coil therein such that the keypad PCB and the magnet form a planar audio speaker, and wherein the keypad PCB includes a polyimide flexible printed circuit diaphragm having the speaker coil printed on one side thereof and a keypad circuit printed on a second, opposing side.

15. The electronic device of claim 14, wherein the magnet is an NdFeB bonded magnet and has a thickness of about 0.5 mm.

* * * * *